United States Patent [19]

Ratelle et al.

[11] 4,047,549

[45] Sept. 13, 1977

[54] LOG BARKING AND CLEANING MACHINE

[75] Inventors: Clement Ratelle, St. Laurent; Pierre Rouillard, Repentigny, both of Canada

[73] Assignee: Clement Ratelle, St. Laurent, Calif.

[21] Appl. No.: 685,353

[22] Filed: May 11, 1976

[30] Foreign Application Priority Data

Aug. 21, 1975 Canada ..... 233871

[51] Int. Cl.[2] ..... B08B 3/00; B27L 1/00

[52] U.S. Cl. ..... 144/208 D; 134/122 R; 144/311

[58] Field of Search ..... 134/122 R; 144/208 R, 144/208 D, 311

[56] References Cited

U.S. PATENT DOCUMENTS

| | | | |
|---|---|---|---|
| 2,552,871 | 5/1951 | Shaw | 144/208 D |
| 2,578,804 | 12/1951 | Holveck et al. | 144/208 D |
| 2,709,465 | 5/1955 | Hansel | 144/208 D |
| 2,765,012 | 10/1956 | Riddell et al. | 144/208 D |

*Primary Examiner*—Othell M. Simpson
*Assistant Examiner*—W. D. Bray

[57] ABSTRACT

A machine adapted for barking and cleaning a log, having jet nozzles, and featuring mounting each jet nozzle on its own log feeler arm for individual displacement of the jet nozzles in accordance with the hills and valleys sensed by the log feeler arms at the periphery of the log, whereby to automatically and individually maintain each nozzle at a predetermined spacing from the bark. This log barking and cleaning machine further comprises an endless conveyor defining a log path, a support structure extending around the log path, log feeler arms pivoted at one end to the support structure, and having a liquid jet nozzle at the other end, a spring wire connected to each arm and biasing the latter toward operative log feeling contact with the periphery of the log, means to adjust the bias of each spring wire, and a liquid manifold and hydraulic supply tubes connected to the nozzles to feed pressurized liquid through the nozzles.

10 Claims, 6 Drawing Figures

LOG BARKING AND CLEANING MACHINE

This invention relates to a log barking and cleaning machine, more particularly of the type using liquid jets to remove the bark.

Various barking machines of the above type have been proposed so far and have disclosed some device to automatically adjust the transverse position of the jets in relation to the size of the log being processed. The above-mentioned devices which have been proposed so far are adapted to automatically and concurrently position all the jet nozzles irrespective of the circumferential irregularities of the log. This is satisfactory for generally uniform logs but a source of troubles in the case of circumferentially irregular logs, since some nozzles are thus too far from the bark to be effective thereon.

It is a general object of the present invention to provide a log barking and cleaning machine of the above type which produces more efficient barking, as compared to the afore-mentioned various barking machines.

It is a more specific object of the present invention to provide a log barking and cleaning machine of the above type, wherein the spacing of each liquid jet nozzle from the bark is individually and automatically adjusted with respect to the adjoining peripheral portion of the log.

It is a still more specific object of the present invention to independently mount each jet nozzle onto a corresponding log feeler arm, such that each arm will feel the hills and valleys passing by the corresponding nozzle upon endwise displacement of the log and will correspondingly pivot to substantially maintain the corresponding nozzle at a predetermined spacing from the bark.

The above and other objects and advantages of the present invention will be better understood with the following detailed description of preferred embodiments thereof which are illustrated, by way of example, in the accompanying drawings, in which.

Figure 1:
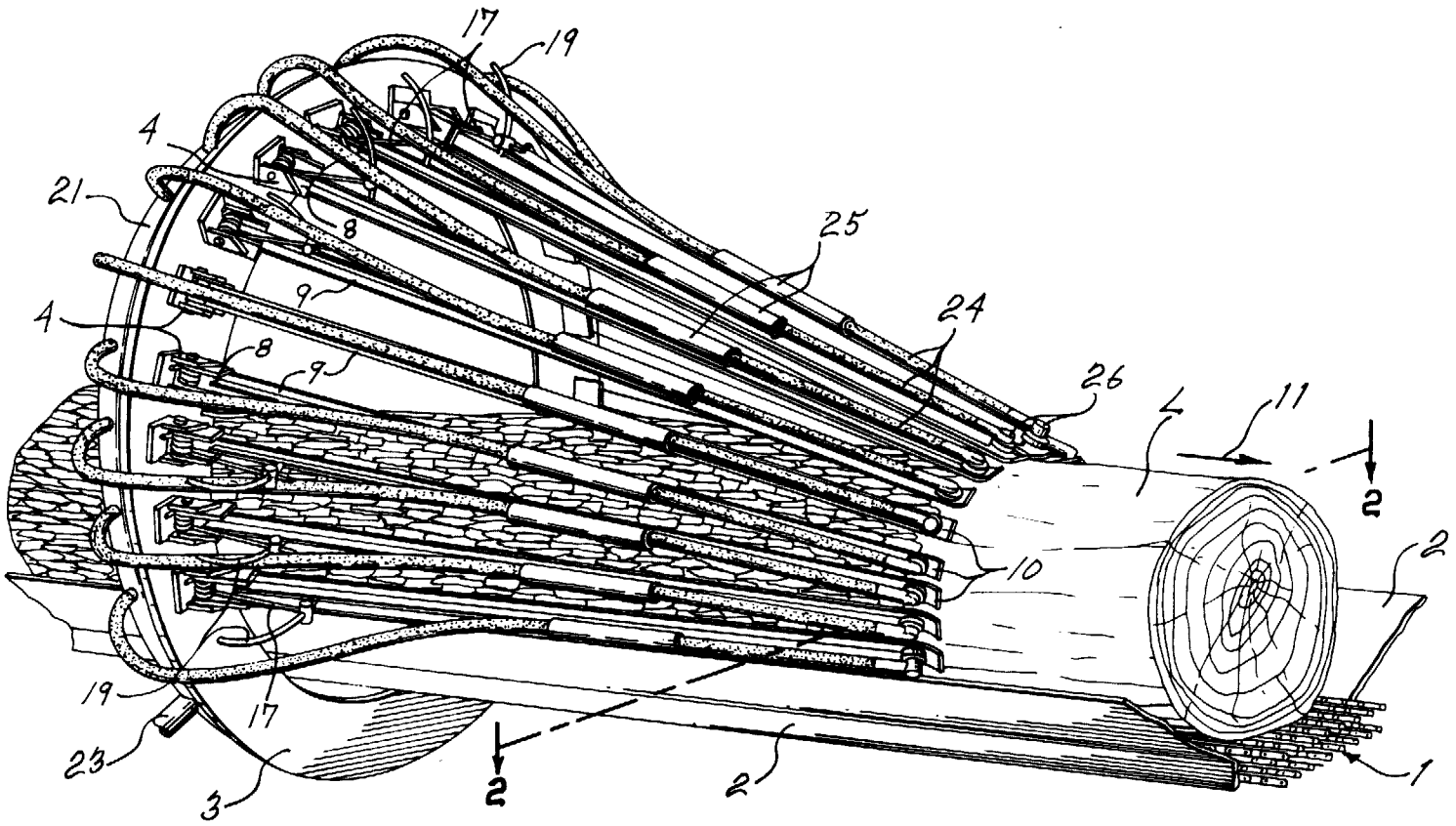
FIG. 1 is a perspective view of a log barking and cleaning machine according to a first embodiment of the invention.

As illustrated in FIGS. 1 to 5 inclusive, the log barking and cleaning machine according to the first embodiment of the present invention includes an endless conveyor 1, formed of interconnected chain links running intermediate a pair of laterally spaced-apart log guides 2. The latter downwardly converge laterally inwardly toward the endless conveyor 1, to form a log trough with the latter and cooperatively define a log path therewith. A rigid ring 3 is engaged around the endless conveyor 1 and the log guides 2 and, consequently, thus also around the log path.

Brackets 4 are secured against one face of the ring 3 and are angularly spaced along the latter. The bracket 4 includes a back plate 5 forming an abutment lug or a projection 6.

A pivot pin 7 transversely extends longitudinally through each bracket 4 tangentially relative to the afore-mentioned log path. A U-shape bracket 8 is pivoted between the opposite sides of each fixed bracket 4 by the corresponding pivot pin 7. A rigid arm 9 is fixed at one end to each U-shape bracket 8 for pivotal movement therewith about the axis of the corresponding pivot pin 7. The rigid arms project away from the brackets 4 and thus from the support ring 3 in the direction of endwise displacement of the logs. Each arm 9 is formed with a flat inner base which is outwardly curved at the free end 10 opposite to the pivoted end. As best seen in FIG. 1, these outwardly curved free ends 10 form each a log contact portion operatively slidable longitudinally relative to a log L which is operatively conveyed endwise in the direction of the arrow 11 by the endless conveyor 1.

A pair of ears 12 are fixed to the opposite sides respectively of each U-shaped bracket 8 and a stop screw 13 is threaded into each ear 12 and adapted to abut against the inclined edge 14 of the corresponding side of the associated fixed bracket 4. The screws 13 may be selectively screwed to adjust the ultimate inward pivoting limit of the arms 9.

A spring wire 15 is coiled around each pivot pin 7 and includes one end 16 fixedly abutting against the corresponding abutment lug 6, and the other end 17 extending diametrically through a cylindrical block 18. An arch-shape rod 19 is rigidly secured to each rigid arm 9 and extends substantially coaxial to the corresponding pivot pin 7 on the external side of the arm. A setscrew 20 extends into the end of each cylindrical block 18 which is on opposite side of the corresponding end 17 relative to the arch-shape rod 19. Each setscrew 20 may thus lock the corresponding block 18 in any desired position along the corresponding arch-shape rod 19 to thus adjust the compression in the corresponding spring wire 15. The inward biasing force on each rigid arm 9 may thus be selectively adjusted.

A tubular ring 21 is fixed against the opposite side of the support ring 3, as compared to the brackets 4, and forms a tubular manifold to hold water under high pressure.

A water pump and motor unit 22 are connected by a supply tube or pipe 23 to the tubular manifold ring 21 to supply the latter with water under high pressure.

A water supply tube or hose 24 is mounted onto each rigid arm 9 by a sleeve 25 and runs along the associated arm. Each water supply tube is connected at one end to the tubular manifold ring 21 and has its other end connected to any appropriate or desired type of water jet nozzle, such as the nozzles 26. The water jet nozzles 26 are fixed on the external side of the arm to prevent contact with the log but they project their water jet inwardly through an aperture 27, shown in FIG. 3. Each aperture 27 extends through the base of the corresponding arm 9 and adjacent the outwardly curved end portion 10 thereof.

Figure 2:
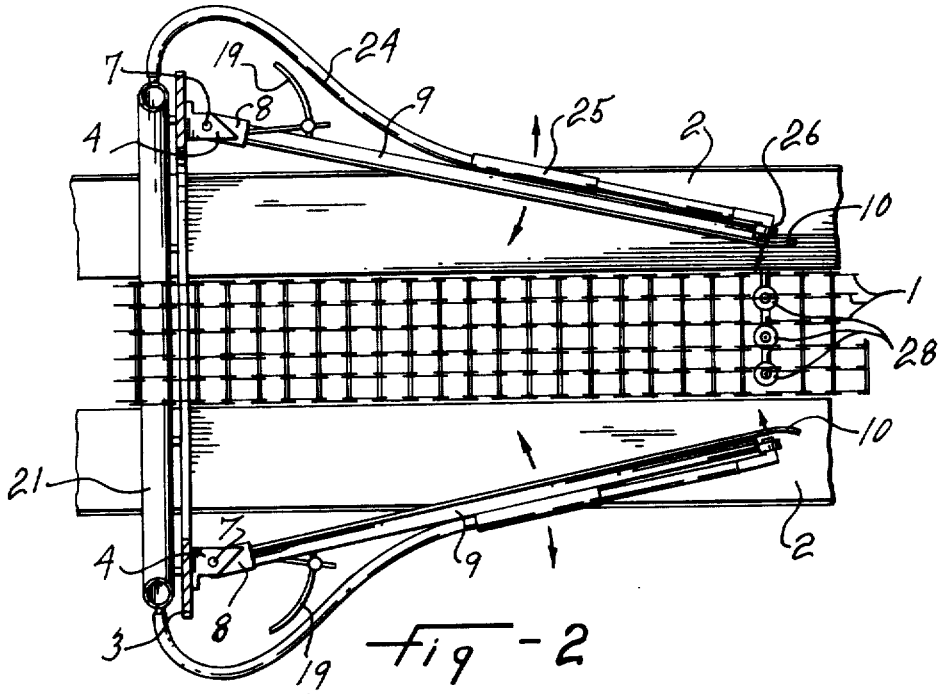
FIG. 2 is a cross-sectional view of the log barking machine of FIG. 1 as seen along line 2—2 in the latter.
Figure 3:
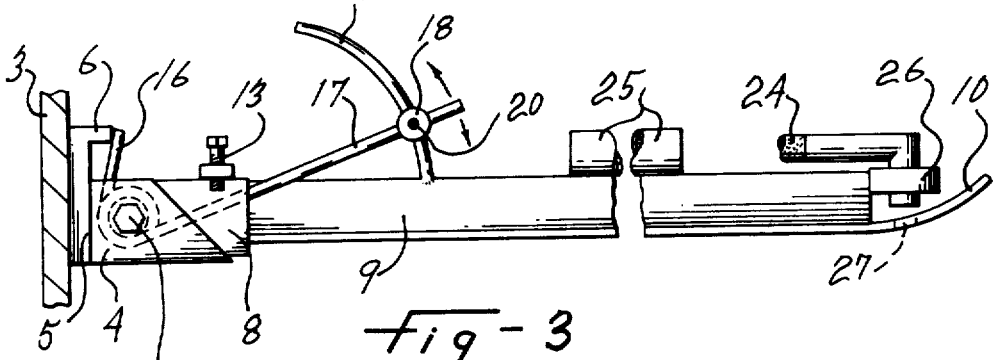
FIGS. 3 and 4 are a side and a top views respectively of an arm which carries a nozzle according to the present invention.
Figure 4:
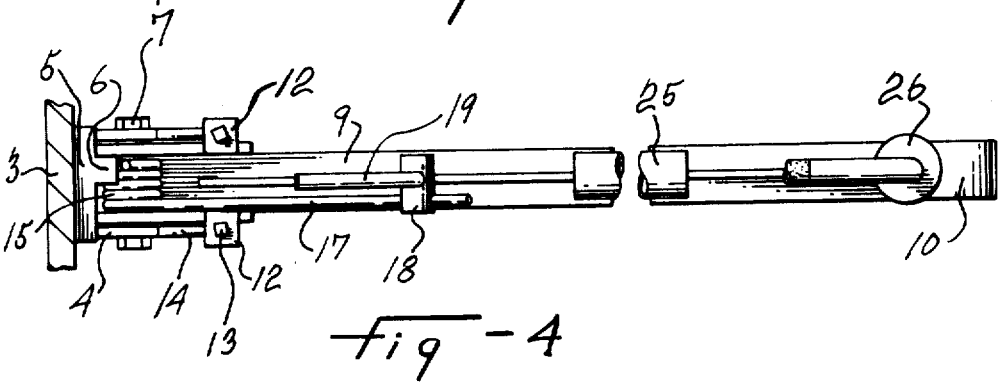
Figure 5:
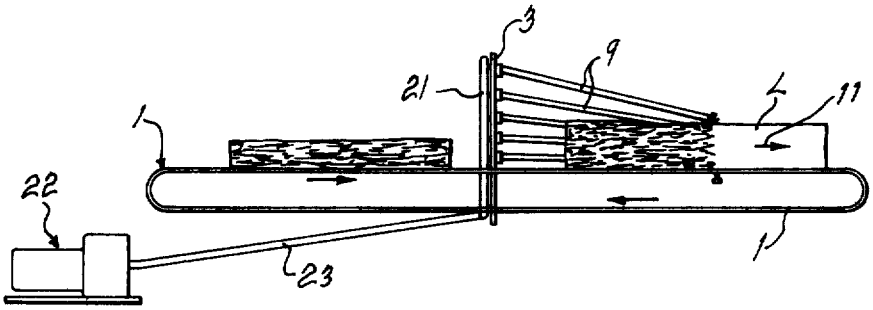
FIG. 5 is a schematic side elevation view of the log barking and cleaning machine according to the first embodiment of the present invention.

The rigid arms 9 pivot into planes converging toward the log path. Rigid arms 9 are provided around the upwardly exposed periphery of the log L and fixed jet nozzles 28, as shown in FIG. 2, and are positioned to bark the downwardly exposed periphery of the log. The water jet nozzles 28 are connected also to the hydraulic supply system formed by the annular manifold 21, the tube 23 and the motor and pump unit 22.

Although only one set of transversely aligned water jet nozzles is shown, it must be understood that two sets of nozzles may be used one ahead of the other along the path with the required apertures through the arms 9. The use of two sets of nozzles, as above, would advantageously allow to first produce longitudinal cutting of the bark in strips with the nozzles of the first set and to peel off the resulting longitudinal strips with the nozzles of the second set. This methodis defined in detail in our U.S. Pat. No. 3,942,565, dated Mar. 9, 1976, entitled: "LOG CLEANING AND BARKING."

Figure 6:
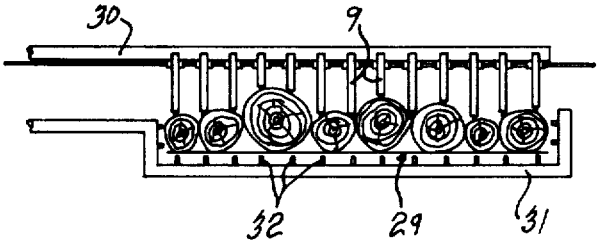
FIG. 6 is a schematic front view of a log barking and cleaning machine according to a second embodiment of the present invention.

The above-described embodiment of FIGS. 1 to 5 inclusive is suited for logs of any size. But the embodiment of FIG. 6 is particularly adapted for the smaller logs. In this second embodiment, the log barking and cleaning machine includes a wider endless conveyor 29 which may also be of the link chain type and which defines a log path of multi-log breadth. In other words, the large conveyor 29 is adapted to convey a plurality of logs endwise in side-by-side relationship.

A plurality of arms 9 are pivoted like the arms of the first embodiment but in substantially parallel planes rather than in planes converging toward a single log. Thus, the rigid ring 3 of the first embodiment is replaced by a straight crossbar or transverse support member, not shown. The water supply manifold in this embodiment includes a top water supply section 30 and a bottom water supply section 31. Fixed nozzles 32 are connected to the bottom water supply manifold section 31. The arms 9 of FIG. 6 are otherwise constructed, arranged and pivoted like those of the first embodiment with the same associated elements, such as the brackets 4 and 8, the pivot pin 7, the spring wire 15, the abutment screws 13 and the setscrew 20.

It must be noted that numerous changes in the details of construction of the present invention may be made without departing from the spirit and scope of the latter as defined by the appended claims.

What we claim is:

1. In a log barking and cleaning machine defining a path for endwise displacement of at least one log therethrough, the combination comprising a support structure extending transversely to the log path and adjacent the latter, arms pivoted to said support structure in planes extending longitudinally of the log path and intercepting the latter, spring means connected to said arms and inwardly biasing the latter toward operative engagement with a log conveyed endwise along the log path, a liquid jet nozzle secured to each of said arms and inwardly directed toward the log path, and a hydraulic supply system connected to said liquid jet nozzles and arranged to supply liquid under pressure to the latter.

2. A log barking and cleaning machine as defined in claim 1, wherein said log path is of multi-log breadth for the passage of a plurality of logs in side-by-side relationship, said support structure includes a top member transversely overlying the log path, and the arms are pivoted to the top member in substantially parallel relationship relative to each other, and the spring means downwardly biases the arms toward engagement with the plurality of logs.

3. A log barking and cleaning machine as defined in claim 2, further including a log conveyor adapted to produce endwise displacement of the plurality of logs in side-by-side relationship and defining the log path, a top and a bottom water supply manifold sections transversely extending relative to the log conveyor above and below the log path respectively, hydraulic supply tubes connecting the liquid jet nozzles respectively to the top manifold section, and other liquid jet nozzles rigidly fixed serially along the bottom liquid manifold section and operatively directed toward the logs and positioned at a predetermined spacing from the latter.

4. A log barking and cleaning machine as defined in claim 1, wherein the arms are pivoted to said support structure at angularly spaced-apart positions around the log path and are biased toward convergence of said nozzles one with the others.

5. A log barking and cleaning machine as defined in claim 4, wherein each arm includes a log contact portion operatively biased by the spring means for slidable engagement of a log therewith, and each liquid jet nozzle is secured to the corresponding arm at a predetermined outward distance from the associated log contact portion and relative to the log path.

6. A log barking and cleaning machine as defined in claim 5, wherein the logs are conveyed in a predetermined direction along the log path, the arms are pivoted at one end to said support structure and the log contact portion is formed at the opposite end of the arm, the arms project in said direction from the support structure, and the spring means includes spring wires operatively connected to the arms respectively and to the support structure.

7. A log barking and cleaning machine as defined in claim 1, further including fixed liquid jet nozzles inwardly directed toward the log path and guideways defining the latter and restraining the logs for said displacement thereof at a fixed distance from the fixed liquid jet nozzles.

8. A log barking and cleaning machine as defined in claim 7, wherein said guideways include a pair of laterally spaced-apart guide members and an endless conveyor extending lengthwise in registry with the space between the guide members, and said fixed liquid jet nozzles underly said space and point toward the overlying log path.

9. A log barking and cleaning machine as defined in claim 1, wherein said support structure includes a rigid ring engaged around the log path, said hydraulic supply system includes a water supply manifold extending around the log path and secured against one side of said rigid ring, and liquid supply tubes connecting the liquid jet nozzles respectively to the water supply manifold and said arms are pivoted at one end to said rigid ring on the opposite side thereof relative to the water supply manifold.

10. A log barking and cleaning machine as defined in claim 1, wherein said spring means includes a spring wire connected to each of said arms, having opposite ends in abutment against said support structure and the corresponding arm, and an adjustment device adjustably connecting one of the opposite ends of the corresponding arm relative to the element in abutment therewith.

* * * * *